US005436650A

United States Patent [19]

Kobayashi et al.

[11] Patent Number: 5,436,650

[45] Date of Patent: Jul. 25, 1995

[54] INK JET RECORDING HEAD, PROCESS FOR PRODUCING THE HEAD AND INK JET RECORDING APPARATUS

[75] Inventors: Junichi Kobayashi, Ayase; Masatsune Kobayashi, Yokohama; Ryuichi Arai, Tokyo; Akihiko Shimomura; Akio Kashiwazaki, both of Yokohama, all of Japan

[73] Assignee: Canon Kabushiki Kaisha, Tokyo, Japan

[21] Appl. No.: 907,620

[22] Filed: Jul. 2, 1992

[30] Foreign Application Priority Data

Jul. 5, 1991 [JP] Japan ..... 3-165413
Oct. 30, 1991 [JP] Japan ..... 3-284674

[51] Int. Cl.[6] ..... B41J 2/05
[52] U.S. Cl. ..... 347/63; 347/65
[58] Field of Search ..... 346/140 R; 347/63, 65

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,437,100 | 3/1984 | Sugitani et al. | 346/1.1 |
| 4,459,600 | 7/1984 | Sato et al. | 346/140 R |
| 4,463,359 | 7/1984 | Ayata et al. | 346/1.1 |
| 4,509,063 | 4/1985 | Sugitani et al. | 346/140 R |
| 4,558,333 | 12/1985 | Sugitani et al. | 346/140 R |
| 4,657,631 | 4/1987 | Noguchi | 156/655 |
| 4,688,053 | 8/1987 | Noguchi et al. | 346/140 R |
| 4,723,129 | 2/1988 | Endo et al. | 346/1.1 |
| 4,740,796 | 4/1988 | Endo et al. | 346/1.1 |
| 4,970,532 | 11/1990 | Komuro et al. | 346/140 R |
| 5,030,317 | 7/1991 | Noguchi | 156/630 |

FOREIGN PATENT DOCUMENTS

| | | |
|---|---|---|
| 0231790 | 8/1987 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 61-154947 | 7/1986 | Japan . |
| 62-253457 | 11/1987 | Japan . |

OTHER PUBLICATIONS

IBM Technical Disclosure Bulletin, "Bonding Ink Jet Nozzle Plates to Base Plates", Missel et al., vol. 21, No. 1, Jun. 1978.

Thin Solid Films, "An Analysis of Thermal Stresses In a Multilayer Thin Film Printhead", Jou et al., vol. 201, No. 2, Jun. 1991.

*Primary Examiner*—Benjamin R. Fuller
*Assistant Examiner*—Valerie Lund
*Attorney, Agent, or Firm*—Fitzpatrick, Cella, Harper & Scinto

[57] ABSTRACT

An ink jet recording head comprises an ink path communicating with an orifice for discharging an ink, and energy-generating means for generating energy to be utilized for discharging the ink from the orifice, provided along the ink path, wherein a base member provided with the energy-generating means and a resin member provided with a recess for forming the ink path are bonded to each other while keeping the recess inside, thereby forming the ink path, and wherein a shearing bonding force between the resin member and the base member is larger than a stress generated due to a difference in coefficient of thermal expansion between the resin member and the base member.

6 Claims, 6 Drawing Sheets

INK JET RECORDING HEAD, PROCESS FOR PRODUCING THE HEAD AND INK JET RECORDING APPARATUS

BACKGROUND OF THE INVENTION

1. Field of the Invention

The present invention relates to an ink jet recording head which comprises an ink liquid path communicating with a discharging orifice for discharging an ink, and an energy generation means for generating energy utilized to discharge the ink from the discharging orifice, provided along the ink liquid path, a process for producing the ink jet recording head, and an ink jet recording apparatus, which comprises the ink jet recording head.

2. Related Background Art

An ink jet recording head generally comprises five orifices for discharging an ink, ink liquid paths provided for each of the five orifices and communicating with the five orifices, respectively, and an energy generating means for generating energy for discharging the ink, provided each at parts of the individual ink liquid paths. In most cases, one ink jet recording head is provided with a large number of discharging orifices and common liquid chamber to the individual ink liquid paths, which serves to stably supply the ink to the individual ink liquid paths As the energy generating means, a device for converting electric energy to discharge energy, for example, an electro-thermal converting element or a piezoelectric device, is used.

Typical processes for producing an ink jet recording head are as follows:

(1) A process which comprises providing a first base member provided with an energy generating means and a second base member composed of glass or metal, forming discharging orifices, in the second base member by processing means such as cutting or etching, ink liquid paths, a recess for forming a liquid chamber and a supplying hole communicating the liquid chamber with the outside, the positioning the energy generating means of the first base member to the ink liquid paths of the second base member, and bonding the second base member to the first base member by an adhesive.

(2) A process which comprises pasting a positive type, photosensitive resin dry film on a base member composed of, for example, glass and provided with an energy generating means, exposing the photosensitive dry film to light and developing the film by photolithography, thereby providing a solid layer with a pattern corresponding to discharging orifices, ink liquid paths and a liquid chamber on the base member, then applying a liquid curable material containing a curing agent on the solid layer and the base member to a desired thickness, leaving the applied base member at a desired temperature for a desired time, thereby curing the curable material, then cutting the base member at an orifices-forming position, thereby exposing the edge surface of the solid layer, and dipping the base member in a solution capable of dissolving the solid layer, thereby removing the solid layer from the base member by dissolution and forming the ink liquid paths and a space for the liquid chamber inside the base member (Japanese Patent Application Laid-Open No. 61-154947 corresponding to U.S. Pat. No. 4,657,631).

(3) A process which comprises pasting a photosensitive dry film on a first base member provided with an energy generating means, exposing the photosensitive dry film to light and developing the film, thereby forming a solid layer with a pattern corresponding to discharging orifices, ink liquid paths and a portion of a liquid chamber on the first base member, applying an active energy ray-curable material which can be cured with an active energy ray such as ultraviolet rays or electron beams, on the solid layer and the first base member to a desired thickness, providing a second base member capable of transmitting the active energy ray therethrough, provided with a recess for forming another portion of the liquid chamber and a supplying hole, pasting the second base member on the active energy ray-curable material so that the recess of the second base member can be provided at a position destined to form the liquid chamber, thereby forming a laminate, then masking the second base member so as to mask the portion destined to form the liquid chamber, irradiating the active energy ray-curable material with the active energy ray through the second base member, thereby curing the active energy-curable material, then cutting the laminate at an orifices-forming position, thereby exposing the edge surface of the solid layer, removing the solid layer and uncured active energy ray-curable material from the laminate by dissolution, thereby forming ink liquid paths and a space destined to form the liquid chamber inside the laminate (Japanese Patent Application Laid-Open No. 62-253457 corresponding to U.S. Pat. No. 5,030,317).

In the production of an ink jet recording head, the above-mentioned process (1) can provide a large liquid chamber suitable for high speed recording, but requires exact positioning of five energy generating means of the first base member to five ink liquid paths of the second base member before bonding of these two members, resulting in complication and higher cost of an apparatus for this purpose, unappropriateness for mass production and an increase in the product cost as problems. The above-mentioned process (2) requires no such exact positioning, but the volume of the liquid chamber is restricted by the thickness of the patterned solid layer and no larger liquid chamber can be formed. Furthermore, the process steps are so many and complicated as to require much time. Thus, the process is not appropriate for mass production, resulting in an increase in the product cost as a problem. The above-mentioned process (3) can provide a larger liquid chamber, because the recess for forming another portion of the liquid chamber can be made larger and requires no such exact positioning, but the process steps are so many and complicated as to require much time and the process is not appropriate for mass production, resulting in an increase in the product cost as a problem, as in the process (2).

To solve the problems, such a process has been proposed, which comprises providing a solid layer with a pattern corresponding to discharging orifices, ink liquid paths, and a portion of a liquid chamber on a base member provided with an energy generating means, forming the orifices, the ink liquid paths and the liquid chamber on the base member by integral molding of synthetic resin and then removing the solid layer by dissolution. In this case, the solid layer acts substantially as a portion of a mold for the integral molding, contributing to formation of the ink liquid paths as undercut parts. However, the ink jet recording head produced by the process still has such problems as peeling or separation of the integrally molded synthetic resin from the base member due to a difference in temperature between the production and the application or occurrences of print twisting or splashes due to cross-talk at the printing.

SUMMARY OF THE INVENTION

An object of the present invention is to provide a highly reliable, low cost ink jet recording head having a large liquid chamber suitable for mass production by simple and smaller process steps, a process for producing the head and an apparatus comprising the head.

The present invention provides an ink jet recording head characterized by bonding a base member provided with an energy generating means to a resin member provided with a recess for forming ink liquid paths so that the recess can be provided on the inside, thereby forming the ink liquid paths, wherein the shearing bonding force between the resin member and the base member is larger than a stress generated due to a difference between the coefficient of thermal expansion of the resin material and that of the base member, or by bonding a base member provided with an energy generating means to a resin member provided with a recess for forming ink liquid paths so that the recess can be provided on the inside, thereby forming the ink liquid paths, wherein the shearing bonding force between the resin member and the base member is larger than a stress generated in the resin member at the molding of the resin member.

The present invention further provides a process for producing an ink jet recording head, characterized by comprising the steps of forming a solid layer composed of a removable material at parts destined to ink liquid paths on a base member, providing a resin having a larger shearing bonding force to the base member than a stress generated due to a difference in the coefficient of thermal expansion between the resin and the base member on the base member provided with the solid layer by transfer molding so as to cover the solid layer, and removing the solid layer, thereby forming the ink liquid paths, or by comprising the steps of forming a solid layer composed of a removable material at parts destined to ink liquid paths on a base member, providing by transfer molding a resin having a larger shearing bonding force to the base member than a stress generated at the transfer molding on the base member provided with the solid layer so as to covering the solid layer, and removing the solid layer, thereby forming the ink liquid paths.

The present ink jet recording apparatus comprises the above-mentioned ink jet recording head whose discharging orifices are arranged to counterpose the recording surface of a recording member, and a member for mounting the head.

The base member provided with an energy generating means and the resin member for integrally forming orifices and ink liquid paths generally have different coefficients of thermal expansion, and when the shearing bonding force between the resin member and the base member is made larger than a stress due to a difference in the coefficient of thermal expansion therebetween, peeling or clearance due to a difference in temperature between the production and the application never occurs at the bonding interface between the base member and the resin member.

Generally, the resin member for molding undergoes volume shrinkage during the curing (or cross-linking) at the molding to generate a stress, and when a shearing bonding force between the base member and the resin member is made larger than the stress at the molding, peeling due to the stress never occurs at the bonding interface between the base member and the resin member.

In any of the foregoing cases, the stress of the resin member is to be reduced or the shearing bonding force between the base member and the resin member is to be increased. The stress of the resin member can be reduced, for example, (1) by adding a plasticizer, etc. to the resin member or (2) by mixing a pigment, etc. into the resin member, thereby reducing the heat shrinkage of the resin member. The shearing bonding force can be increased, for example, (1) by treating the surface of the base member with a silane coupling agent, etc. or (2) by etching the surface of the base member. By combination of these steps for reducing the stress or increasing the shearing bonding force, a better result can be obtained.

In the present process for producing an ink jet recording head, a solid layer composed of a removable material is formed at parts destined to ink liquid paths on a base member, and a resin is further provided by transfer molding so as to cover the solid layer and then the solid layer is removed to form ink liquid paths. Thus, the ink liquid paths are positioned on the base member with high exactness through less steps.

BRIEF DESCRIPTION OF THE DRAWINGS

FIG. 4A is a schematic perspective view showing a base member, FIG. 4B is a schematic perspective view showing a solid layer and FIG. 4C is a cross-section view showing the essential part of a mold for use in the molding of a structural member.

FIG. 5A is a schematic plan view showing the structural member after release from the mold, FIG. 5B is a cross-sectional view along the line A—A of FIG. 5A, and FIG. 5C is a cross-section view along the line A—A of FIG. 5A after removal of a solid layer.

FIG. 6A is a schematic perspective view showing a base member, FIG. 6B is a schematic perspective view showing a solid layer, FIG. 6C is a cross-sectional view showing the essential part of a mold for use in molding of a structural member, and FIG. 6D is a perspective cross-sectional view showing the structural member after release from the mold.

DETAILED DESCRIPTION OF THE PREFERRED EMBODIMENTS

The present invention will be explained in detail below, referring to embodiments and drawings.

Figure 1:
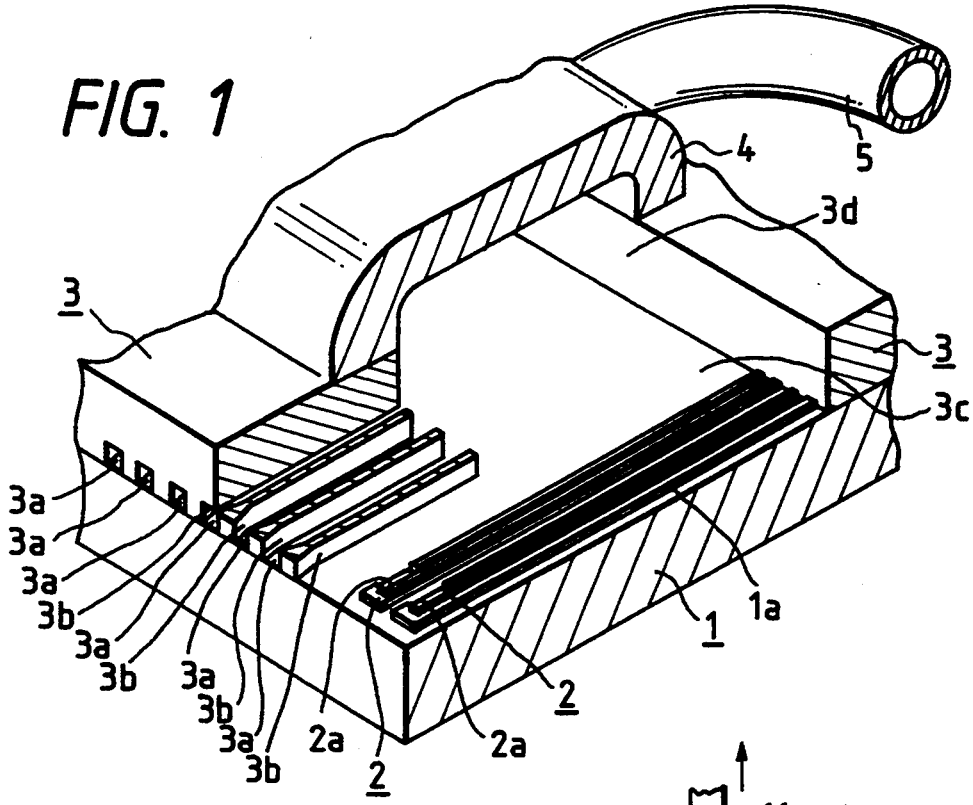
FIG. 1 is a partly cutaway perspective view showing the structure of an ink jet recording head according to one embodiment of the present invention.
Figure 2:
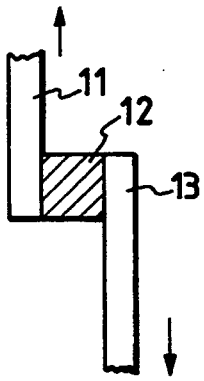
FIG. 2 is a view showing a method for determining a shearing bonding force.

At first, one embodiment of the present ink jet recording head will be explained. FIG. 1 is a partially cutaway perspective view showing the structure of an ink jet recording head according to one embodiment of the present invention, and FIG. 2 is a view showing a method for determining a shearing bonding force.

In FIG. 1, heat generating parts of an electro-thermal converting elements ($HfB_2$) 2*a* and a plurality of Al electrodes 2 are formed at predetermined distances in a film form on one surface of a base member 1 composed of glass or silicon wafer by a well known semi-conductor-producing process such as etching, vapor deposition, or sputtering, and the one surface of the base member 1 constitutes an element surface 1*a*. A structural member 3 consisting of a single member is fusion-welded onto the element surface la by integral molding such as transfer molding at the same time as the molding. Usually, various functional layers such as a protective film, e.g., $SiO_2$ film or Ta film (not shown in the drawing), are provided on the element surface la including the electrodes 2 and the individual heat generating parts of electro-thermal converting elements 2*a* to improve the durability, etc. In this embodiment, the effect of the present invention can be obtained, irrespective of the presence or absence of these functional layers and their materials.

A plurality of grooves are formed at positions corresponding each to the positions of the heat generating parts of the electro-thermal converting elements 2*a* on the element surface 1*a*-counterposed surface of the structural member 3 as to a resin member, and the spaces formed by the individual grooves and the element surface 1*a* constitute the respective liquid paths 3*b* as ink liquid paths. Openings of the individual spaces to the outside constitute respective orifices 3*a*. A hollow space having the element surface la as the bottom wall and communicating with the respective grooves (liquid paths 3*b*) is formed in the structural member 3 to constitute a liquid chamber 3*c*. An opening communicating the hollow space (liquid chamber 3*c*) with the outside (e.g., connecter 4, as will be explained later, etc. ) is made open in the same direction as the element surface 1*a*—facing direction to constitute a supplying hole 3*d*. A supplying tube 5 connected to an ink tank, etc. (not in the drawings) is connected to the supplying hole 3*d* through the connecter 4 so that the ink can be supplied to the liquid chamber 3*c* through the supplying tube 3*d* from the ink tank.

Materials for the structural member 3 as a resin member will be explained below. A liquid or solid synthetic resin having a liquid state at the molding such as ordinary temperature curability, heat curability or ultraviolet curability can be used for the structural member 3 and includes, for example, epoxy resin, silicone resin, acrylic resin, diglycol-dialkylcarbonate resin, unsaturated polyester resin, polyurethane resin, polyimide resin, melamine resin, phenol resin, urea resin, etc.

The shearing bonding force between the synthetic resin constituting the structural member 3 and the base member 1 must meet at least one of the following two conditions: (1) the shearing bonding force is larger than a stress generated due to a difference in the coefficient of thermal expansion between the synthetic resin and the base member 1, and (2) the shearing bonding force is larger than a stress generated in the synthetic resin at the molding of the structural member 3. In order to meet at least one of these two conditions, the following steps are taken, for example, (1) a plasticizer is added to the synthetic resin constituting the structural member 3 to reduce the stress generated in the synthetic resin; (2) a pigment is added to the synthetic resin constituting the structural member 3 to make the synthetic resin less susceptible to heat shrinkage; (3) both plasticizer and pigment are added to the synthetic resin to reduce the stress in the synthetic resin and prevent heat shrinkage of the synthetic resin; and (4) the surface of the element surface 1*a* of the base member 1 is treated with a silane coupling agent and both plasticizer and pigment are added to the synthetic resin at the same time to increase the shearing bonding force itself, reduce the stress generated in the synthetic resin and make the synthetic resin less susceptible to heat shrinkage.

The shearing bonding force between the synthetic resin constituting the structural member 3 and the base member 1 can be determined. By a procedure shown in FIG. 2, the same synthetic resin 12 as used to make the structural member 3 is fusion welded onto one end surface of the same test member 11 as used for the base member 1 at the same time when molding is carried out. The other side of synthetic resin 12, i.e. the side not in contact with the test member 11, is fixed to the edge surface of a support plate 13. The test member 11 and the support plate 13 can be pulled in directions opposite to each other. The other end of the test member 11 and the other end of the support plate 13 are set to a tension tester (not shown in the drawing) and pulled in the arrow directions as shown in FIG. 2 to measure a tensile force when the test member 11 and the synthetic resin 12 are sheared off. The measured tensile force is a shearing bonding force.

Ink is discharged from the individual orifices 3*a* as follows.

Ink supplied-into the ink chamber 3*c* is introduced into the liquid paths 3*b* by a capillary action, filled in the liquid paths 3*b* and kept therein in that state, while forming meniscuses at the orifices 3*a*. When an electric current is passed to the heat generating parts of the electro-thermal converting elements 2*a* through electrodes 2 to generate heat, the ink on the heat generating parts of the electro-thermal converting elements 2*a* is rapidly heated to generate bubbles in the liquid paths 3*b*, and the ink is discharged from the orifices 3*a* by expansion of the bubbles.

In this embodiment, the energy-generating means for generating energy for discharging an ink is exemplified by electro-thermal converting elements, but is not limited thereto. That is, a piezo-electric device capable of generating mechanical energy that can instantaneously apply a discharge pressure to the ink, etc. can be used. 128 or 256 orifices 3*a* can be formed at such a high density of 16 orifices/mm, and such a number of orifices as to extend the full width of the recording area of a recording member can be formed to make a full-line type.

The ink jet recording head according to this embodiment can be prevented from such a phenomenon as peeling or separation of the structural member 3 from the base member 1 appearing during the production, poor printing due to the peeling or separation and similar peeling or separation appearing during the application for a long time. Generally, peeling of the structural member from the base member during the service for a long time seems to be due to an action of the internal stress remaining in the structural member on some defects in the structural members after heat cycles. When at least one of two conditions that (1) the shearing bonding force between the synthetic resin constituting the structural member and the base member must be larger than a stress generated due to a difference in the coefficient of thermal expansion between the synthetic resin and the base member and (2) the shearing bonding force must be larger than a force generated in the synthetic resin at the molding of the structural member, as explained before, the internal stress remaining in the synthetic resin is lowered as compared with the shearing bonding force, and it seems that no peeling occurs even due to the application for a long time.

Figure 3:
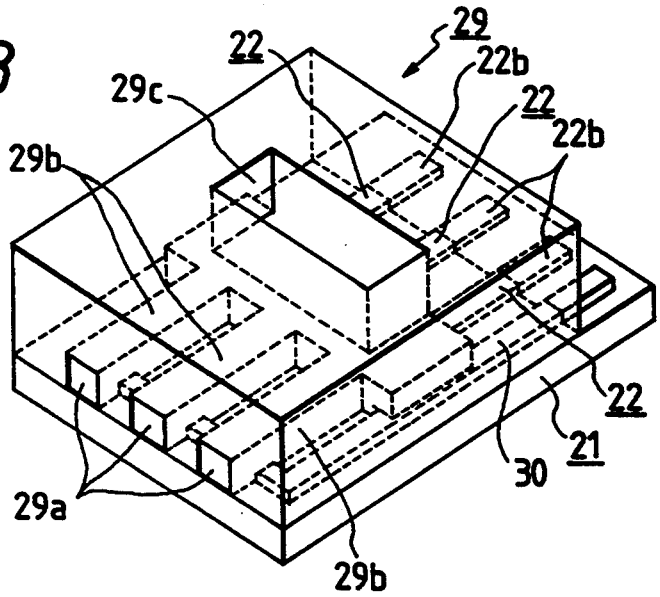
FIG. 3 is a perspective view showing the structure of an ink jet recording head according to another embodiment of the present invention.

A process for producing the present ink jet recording head will be explained below, referring to a case of producing an ink jet recording head, as shown in FIG. 3.

Figure 4A:
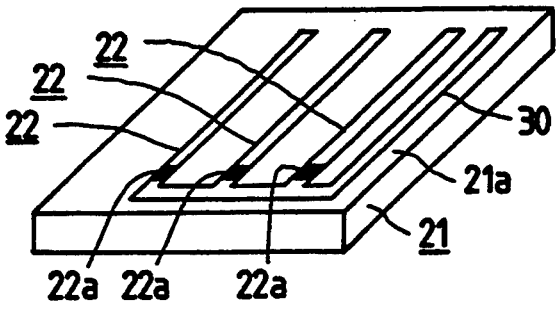
FIGS. 4A to 4C are views showing a process for producing an ink jet recording head according to one embodiment of the present invention.
Figure 4B:
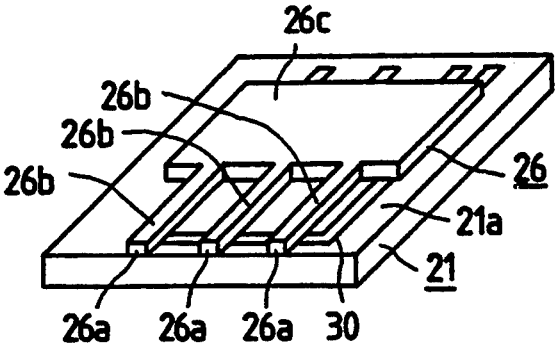
Figure 4C:
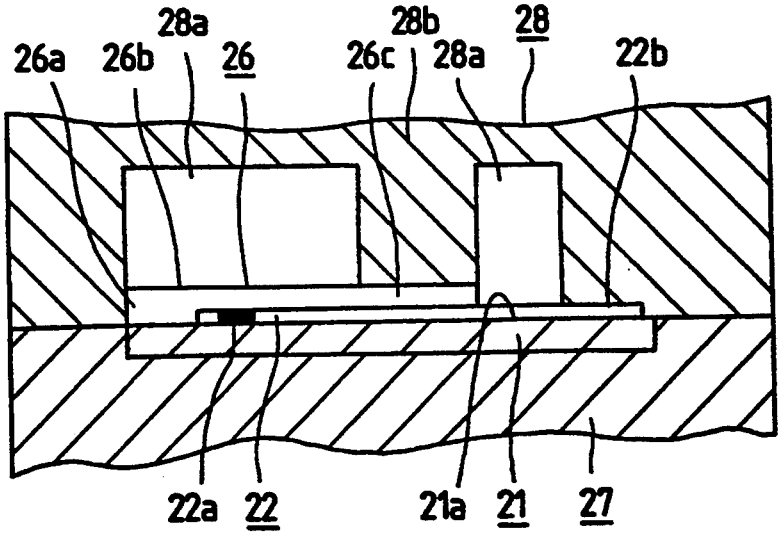
Figure 5A:
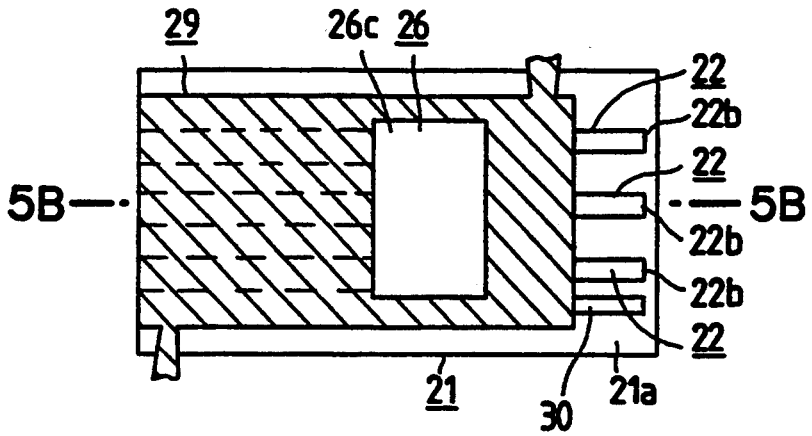
FIGS. 5A to 5C are views showing a process for producing an ink jet recording head according to another embodiment of the present invention.
Figure 5B:
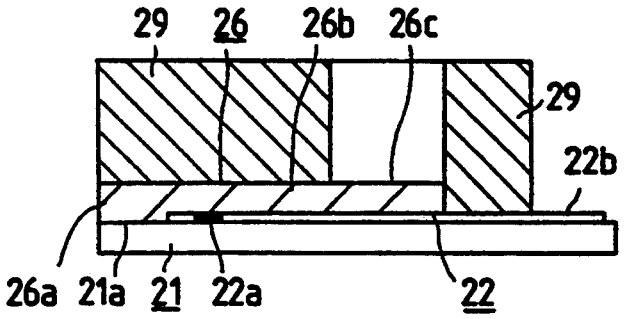
Figure 5C:
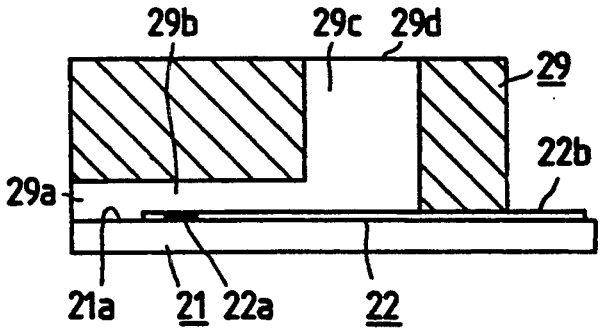
Figure 6A:
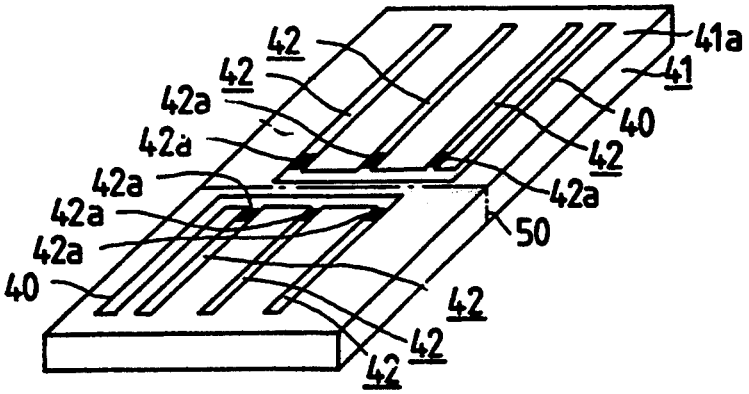
FIGS. 6A to 6D are views showing a process for producing an ink jet recording head according to another embodiment of the present invention.
Figure 6B:
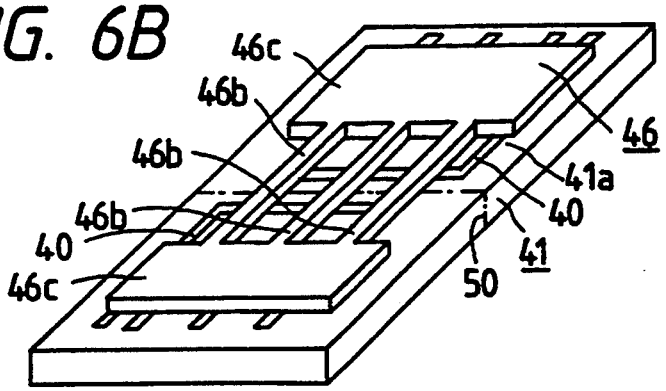
Figure 6C:
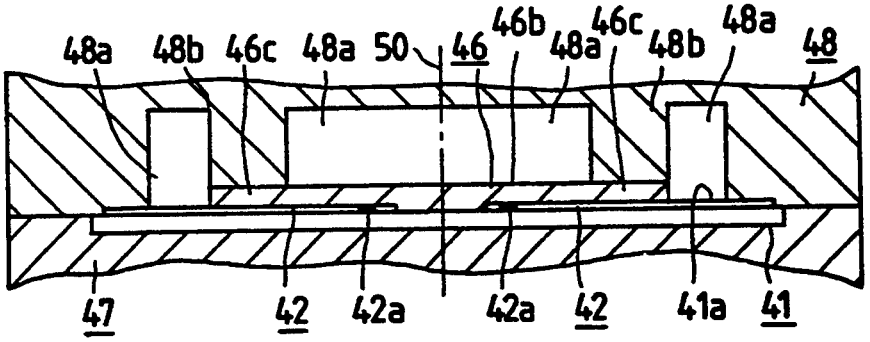
Figure 6D:
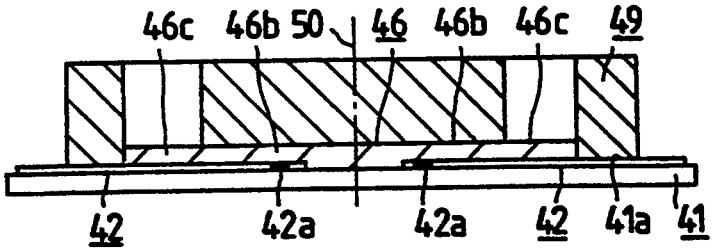

FIG. 3 is a perspective view showing the structure of the present ink jet recording head, and FIGS. 4A to 4C are views explaining the present process, FIG. 4A is a schematic perspective view showing a base member, FIG. 4B is a schematic perspective showing a solid layer, and FIG. 4C is a cross-sectional view showing the essential part of a mold for use in molding of a structural member. FIGS. 5A to 5C are also views explaining the present process, where FIG. 5A is a schematic plan view showing the structural member after release from the mold, FIG. 5B is a cross-sectional view along the line A—A of FIG. 5A, and FIG. 5C is a cross-sectional view along the line A—A of FIG. 5A after removal of the solid layer. FIGS. 6A to 6D are views explaining another case of producing two present ink jet recording heads at the same time, FIG. 6A is a schematic perspective view showing a base member, FIG. 6B is a schematic perspective view showing a solid layer, FIG. 6C is a cross-sectional view showing the essential part of a mold for use in molding of a structural member and FIG. 6D is a schematic cross-sectional view showing the structural member after release from the mold.

At first, the present ink jet recording head shown in FIG. 3 will be explained. The ink jet recording head is similar to that shown in FIG. 1, and is in such a structure that, for simplification of the explanation, three orifices 29*a* are provided, and liquid paths 29*b* and energy generating means corresponding each to the orifices 29*a* are provided. Numbers of the orifices and the corresponding energy generating means and liquid paths are not limited to the above mentioned three.

FIG. 4A shows the structure of the base member 21 of an ink jet recording head, wherein the heat generating parts of three electro-thermal converting elements ($HfB_2$) 22*a*, three Al electrodes 22 connected to the heat generating parts 22*a* at one end, respectively, and a common Al electrode 30 connected to all the heat generating parts 22*a* at another end are formed in a film form by a semiconductor process such as etching, vapor deposition or sputtering and arranged at desired distances on the element surface 21*a* of the phase member 21 made, for example, from glass or silicon wafer. The electro-thermal converting elements are energy-generating means for generating heat energy for discharging an ink, and a piezoelectric device for generating mechanical energy that can apply a discharge pressure instantaneously to an ink, etc. can be used as an energy-generating means. The other parts of the electrodes 22, i.e., the parts not connected to the heat-generating parts 22*a*, are electrical connecting parts 22*b*, and when a voltage is applied between the electrical connecting parts 22*b* and the common electrode 30, the corresponding heat generating parts 22*a* will generate heat.

At first, a solid layer 26 with a pattern corresponding to orifices 29*a* for discharging an ink (FIG. 3), a portion of a liquid chamber 29*c* for storing the ink to be supplied to the orifices 29*a* (FIG. 3), and liquid paths 29*b* communicating the orifices 29*a* with the liquid chamber 29*c* (FIG. 3) is formed on the element surface 21*a* of the base member 21, as shown in FIG. 4B. As a result, the three corresponding parts 26*b* of the solid layer 26 to the liquid paths 29*b* cover the electrodes 22 and the heat-generating parts 22*a*, respectively.

As a means for forming the solid layer 26 on the element surface 21*a*, for example, such a photolithographic means which comprises pasting a positive or negative type, photosensitive dry film having a desired thickness onto the element surface 21*a*, masking or exposing to light the corresponding pattern of the photosensitive dry film to the orifices, liquid paths 29*b* and the liquid chamber 29*c*, and developing the dry film to form the solid layer with a pattern corresponding to the orifices 29*a*, the liquid paths 29*b* and the liquid chamber 29*c* on the element surface 21*a* can be used. In that case, any material can be used for the photosensitive dry film, so long as it can be removed by dissolution with a solvent in the successive step that will be explained later. A positive type, photosensitive dry film is better in the ability to remove the patterned solid layer 26 by dissolution in the successive step which will be explained later and to form the cross-sectional shapes as rectangular as possible than the negative type film.

Besides the photolithographic means, a patterned solid layer 26 can be provided to a desired thickness by a printing means such as screen printing, relief printing using a relief prepared from a metallic base plate (e.g. NiCu) by etching, etc. Materials of a solid layer for use in the printing means include, for example, water-soluble polyvinyl alcohol-based resin, and solvent-soluble vinyl chloride-based, vinyl acetate-based, vinyl chloride-vinyl acetate copolymer-based and styrene-based resins.

The structural member 29 (FIG. 3) is molded and melt-welded simultaneously onto the element surface 21*a* of the base member 21 on which the solid layer has been formed by transfer molding. A mold for use in the transfer molding comprises a primary mold 27 and a secondary mold 28, as shown in FIG. 4C. In the primary mold 27, a recess having a depth equal to the thickness of the base member 21 for inserting and fixing the base member 21 therein is formed in such a structure that, when the base member 21 is inserted in the recess, the element surface 21*a* of the base member 21 is on the same level as the parting surface.

On the other hand, cavity 28*a* for molding the structural member 29 (FIG. 3) constituting the orifices 29*a*, the liquid paths 29*b* and the liquid chamber 29*c* is formed on the secondary mold 28, and a part of the inner walls of the cavity 28*a* abuts the surfaces 26*a* of the solid layer 26 corresponding to three orifices 29*a* when the primary and secondary molds are clamped into a mold. In the secondary mold 28, a projected part 28b for forming a hollow space for the liquid chamber 29c and a supplying hole for supplying an ink into the liquid chamber from the outside is formed within the cavity 28a, and the tip end surface of the projected part 28b abuts the upper surface of the corresponding part 26c of the liquid chamber to the part of the liquid chamber 29c in the solid layer 26. Parts of the individual electrodes 22 covering the electrical connecting parts 22b on the element surface 21a of the base member 21 are in such a structure as to be extended from the cavity 28a to the parting surface side of the secondary mold 28 when clamped into a mold.

The opening directions of the primary mold 27 and the secondary mold 28 are vertical to the element surface 21a of the base member 21. After clamping into a mold, transfer molding is carried out by pouring a molding material into the cavity 28a from a pot through a runner (not shown in the drawing). In molding of the structural member 29, the corresponding surfaces 26a of the solid layer 26 to the individual orifices, which abut the inner walls of the cavity 28a of the secondary mold 28 and the corresponding part 26c to a portion of the liquid chamber, which abuts the tip end surface of the projected part 28b, are melted to some extent by the heat at the molding and brought into tight contact with the inner walls of the cavity 28a and the tip end surface of the projected part 28b to prevent the intrusion of the molding material. A soft member of silicon rubber or the like may be pasted onto the tip end surface of the projected part 28b.

By conducting the transfer molding as above, the structural member 29 is molded and melt welded simultaneously onto the element surface 21a of the base member on which the solid layer 26 has been formed, as shown in FIGS. 5A and 5B. The electrical connecting parts 22b of the individual electrodes 22 are exposed from the structural member 29, and among the surfaces of the solid layer 26, the surface abutted by the projected part 28b of the secondary mold 28, i.e. the corresponding part 26c to a portion of the liquid chamber, and the corresponding surfaces 26a to the orifices are exposed, and other surfaces are covered by the structural member 29.

Transfer molding can be carried with a heat-curable epoxy resin as a material for the structural member 29 under ordinary molding conditions such as a resin preheating temperature of 60° to 90° C., a pouring pressure of 20 to 140 kgf/cm$^2$, a mold temperature of 100° to 180° C., a curing time of 1 to 10 minutes and post-curing after the molding. As other materials for the structural member 29, as mentioned above, liquid or solid materials having a liquid state at the molding such as ordinary temperature curing type, heat-curing type, ultraviolet curing type, etc. can be used and include, for example, epoxy resin, acrylic resin, diglycol dialkylcarbonate resin, unsaturated polyester resin, polyurethan resin, polyimide resin, melamine resin, phenol resin and urea resin. In that case, a material for the structural member 29 is selected so as to meet at least one of the two conditions that (1) the shearing bonding force between the synthetic resin constituting the structural member 3 and the base member 1 must be larger than a stress generated due to a difference in the cofficient of thermal expansion between the synthetic resin and the base member 1 and (2) the shearing bonding force must be layer than a stress generated in the synthetic resin at the molding of the structural member 3. In order to meet at least one of these two conditions, the following steps may be taken: for example, (1) a plasticizer is added to the synthetic resin constituting the structural member 29, (2) a pigment is added to the synthetic resin constituting the structural member 29, (3) both plasticizer and pigment are added to the synthetic resin, or (4) the element surface 21a of the base member 21 is treated with a silane coupling agent and both plasticizer and pigment are added to the synthetic resin at the same time.

Then, the solid layer 26 is removed from the base member 21 on which the structural member 29 has been molded and melt welded simultaneously. For removing the solid layer 26, a most suitable means is selected in view of the material used to form the solid layer 26. Generally, such a means for dipping the base member 21 on which the structural member 29 has been molded and melt welded simultaneously into a solution of a solvent capable of dissolving, swelling and peeling the solid layer 26, thereby removing the solid layer 26 is used. If necessary, a means for accelerating the removal such as an ultrasonic treatment, spraying, heating and stirring can be used at the same time. When a positive-type, photosensitive resin is used for the solid layer 26, ketones such as acetone, esters, alcohols, and aqueous solutions containing an alkali can be used as the removing solvent or solution. FIG. 5C shows the base member 21 simultaneously molded and melt welded with the structural member 29, from which the solid layer 26 is removed, within the structural member 29, spaces are formed, after the removal of the solid layer 26, to constitute three orifices 29a, three liquid paths 29b, a liquid chamber 29c and a supplying hole 29d.

In the foregoing manner, the ink jet recording head as shown in FIG. 3 can be produced. Positioning of the individual liquid paths 29 to the corresponding heat-generating parts of the electro-thermal converting elements 22 provided on the element surface 29b can be carried out when the solid layer 26 is formed on the element surface 21a, and thus any complicated, expensive apparatus is not required for exact positioning of the fine energy-generating means on the first base member to the fine liquid paths on the second base member, as in processes of the prior art.

The step for providing the structural member 29 for consitituting the individual orifices 29a, the individual liquid paths 29b and the liquid chamber 29c is simpler and shorter in the operating time than the conventional complicated, laborious step for providing a structural member by applying a curable material containing a curing agent, followed by standing for a long time or by applying an active energy ray-curable material, followed by irradiation with an active energy ray as in processes of the prior art, because in the present step the structural member 29 can be molded and melt welded simultaneously by transfer molding on the element surface 21a on which the solid layer 26 has been formed. Furthermore the supplying hole 29d can be molded at the same time when the structural member 29 is molded, and the volume of the liquid chamber 29 can be made, as desired, irrespective of the thickness of the solid layer 26.

Another embodiment of the present process for producing an ink jet recording head will be explained below. Two ink jet recording heads, as shown in FIG. 3, can be produced simultaneously by one run (so called two-piece production), that is, two pieces of ink jet recording heads are formed by one run in such a positional relationship that the orifices on one piece are opposite to those on another piece, and then cut at the center in the longitudinal direction to obtain two ink jet recording heads. FIGS. 6A to 6D are views showing this process.

As shown in FIG. 6A, heat-generating parts 42a, electrodes 42 and common electrodes 40, corresponding to those of two ink jet recording heads, are formed on the element surface 41a of a base member 41. In this case, the heat-generating parts 42a are provided in a symmetrical relationship to the cutting position (orifices-forming position 50 in FIGS. 6A to 6D) in the successive cutting step, whereby the corresponding liquid paths of the two ink jet recording heads are linearly connected to one another. Then, as shown in FIG. 6B, a solid layer 46 is provided at the positions destined to the liquid paths and the positions destined to the lower bottom of the liquid chamber. Since the heat-generating parts 42a are provided in the symmetrical relationship to the orifices-forming position 50, the parts destined to the liquid paths, i.e. the corresponding parts 46b to the liquid paths are provided linearly and continuously from the position destined to the lower bottom of one liquid chamber, i.e. the corresponding part 46c, to a portion of the liquid chamber toward the corresponding part 46c to a portion of another liquid chamber.

Then, structural members 49 corresponding to two ink jet recording heads are integrally formed by transfer molding in the same manner as in the foregoing embodiment. Synthetic resin constituting the two structural members 49 are the same as the synthetic resin constituting the structural member 29 in the foregoing embodiment. Then, the base member 41 is cut at the orifices-forming position 50 along the plane vertical to the base member 41 as a cross-sectional plane. Since the parts destined to the liquid paths of the two ink jet recording heads are in linear and continuous alignments, the orifices are exposed on the cross-sectional plane to form two sets of orifices corresponding to those of two ink jet recording heads. Then, the cross-sectional planes are polished and the solid layer 46 is removed from each of the structural members, whereby two ink jet recording heads in the same structure as mentioned in the foregoing embodiment can be obtained by one run at the same time.

Mold for use in the above-mentioned transfer molding will be explained below. FIG. 6C is a cross-sectional view showing a state that the base member 41 with the solid layer 46 formed thereon is in the mold. In a primary mold (lower mold) 47, a recess of the same shape as that of the base member 41 is provided, and the base member 41 is inserted in the recess. In a secondary mold (upper mold) 48, a cavity 48a corresponding to the recess of the primary mold 47 is provided in the same manner as in the foregoing embodiment. Two projected parts 48b corresponding to the respective liquid chambers of two ink jet recording heads are provided in the cavity 48a. The tip ends of the projected parts 48b abut the corresponding parts 46c each to a portion of the liquid chamber, as in the foregoing embodiment. By pouring a molding material into the cavity 48a from a pot through a runner (not shown in the drawing) in that state, followed by curing, a structural member 49 in such a structure that two ink jet recording heads are integrated can be formed on the base member 41.

In this embodiment, two ink jet recording heads can be advantageously obtained at the same time with substantially same labor as in the foregoing embodiment. Furthermore, a large number of ink jet recording heads can be produced by connecting a large number of the molds of this embodiment to one another in a lateral direction (i.e. direction along the line including the orifices-forming position 50) and forming the base members provided with a large number of a pair of two ink jet recording heads arranged in the lateral direction.

Figure 7:
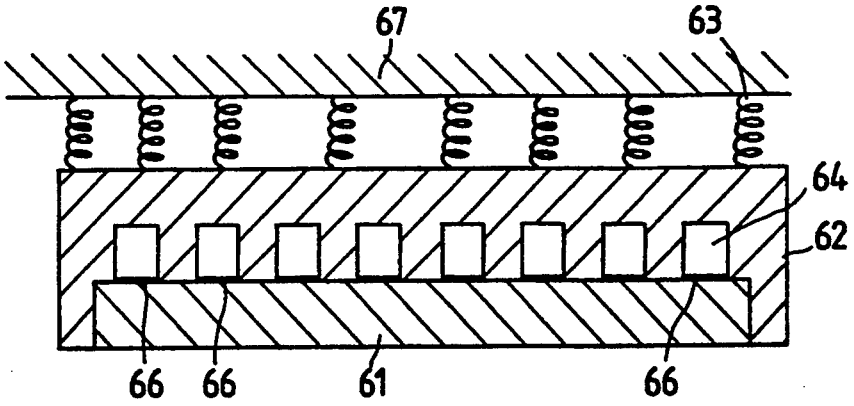
FIG. 7 is a partial cross-sectional view of an ink jet recording head in the discharge direction according to another embodiment of the present invention.

FIG. 7 is a partial cross-sectional view to the discharge direction of an other embodiment of the present ink jet recording head. The ink jet recording head comprises a silicon wafer base member 61, a plurality of energy-generating means 66, for example, heat-generating elements, provided on the base member 61, a grooved ceiling member 62, a plurality of springs 63 pressing the grooved ceiling member 62 onto the base member 61, and a support member 67 for supporting the pressing action of the springs 63. The grooved ceiling member 62 is composed entirely of a rubbery elastomer in this embodiment, and the grooves 64 of the grooved ceiling member 62 are formed at a somewhat narrower pitch than that each of the energy-generating elements 66 provided on the base member 61. When the grooved ceiling member 62 is mounted on the base member 61, the grooved ceiling member 62 is expanded and fixed so that each pitch of the grooves 64 can meet the corresponding pitch of the energy-generating elements 66. The degree of expansion is set to larger than the degree of change in the coefficient of thermal expansion of the rubbery elastomer at 50° C. The grooved ceiling member 62 can be fixed by allowing both sides of the grooved ceiling member 62 to engage with both sides of the base member 61 in such a state that the both sides of the grooved ceiling member 62 enclose the both sides of the base member 61, thereby ensuring the positioning and prevention of dislocation. Furthermore, the grooved ceiling member 62 is pressed onto the base member 61 by the springs 63 and the projections of the rubbery elastomer which constitute the grooves 64 are brought into tight contact with the base member 61 by the pushing action of the springs 63 to attain a sealing effect. Thus, the mixed flow between the ink liquid paths formed by the grooves 64, that is, the so-called cross-talk, can be completely prevented.

The tensile stress of the rubbery elastomer is preferably 10 to 450 kgf/cm$^2$ according to the definition of JIS K 6301.

Figure 8:
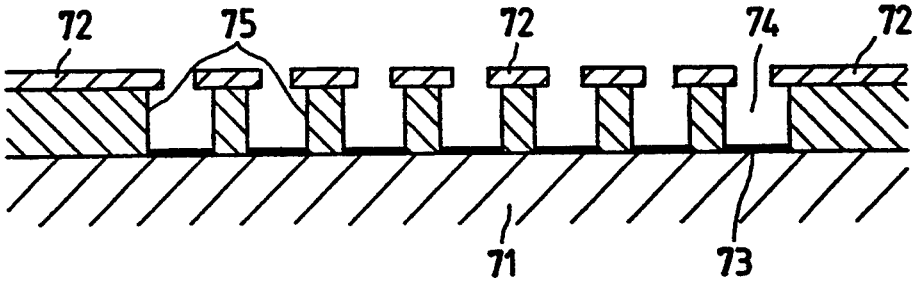
FIG. 8 is a partial cross-sectional view of an ink jet recording head in the discharge direction according to further another embodiment of the present invention.

FIG. 8 is a partial cross-sectional view to the discharge direction of further embodiment of the present ink jet recording head. The ink jet recording head of this embodiment comprises a base member 71, hard liquid path walls 75 provided on the base member 71, grooves 74 formed between the adjacent liquid path walls 75, an orifice plate 72 provided at the free ends of the liquid path walls 75, and energy-generating elements 76 arranged at the bottoms of the grooves 74. The orifice plate 72 is made from a rubbery elastomer and bonded to the free ends of the liquid path walls 75 without giving any tension thereto. Since the orifice plate 72 is made from the rubbery elastomer, the orifice plate 72 expands or contracts according to the expansion or contraction of the liquid path walls 75 even if the temperature is changed, and thus neither peeling nor warping of the member appear on the structure of grooves 74. The tensile stress of the rubbery elastomer is preferably in the same numerical range as above.

In the foregoing embodiments, at least the surface of the ink liquid path. Walls or the orifice plate facing the base member are made from a rubbery elastomer, and thus there is no generation of a stress due to the thermal expansion, and the following remarkable effects can be also obtained. That is, neither peeling nor warping appears on the ink jet recording head with particularly number of energy-generating elements provided thereon.

Printing disadvantages such as non-discharge, print twisting, etc. can be largely overcome. Since at least the surface of the ink liquid path walls or the orifice plate facing the base member are made from a rubbery elastomer, the ink liquid path walls or the orifice plate expand or contract according to a change of the base member by heat, and thus dislocation of the energy-generating elements from the orifices or ink liquid paths can be prevented.

EXAMPLE 1

This example shows reducing the stress to be generated in a synthetic resin constituting the structure member 3 by adding a plasticizer to the synthetic resin.

Polyether polyol was used as the synthetic resin constituting the structure member 3. 20 parts of polyisocyanate as the plasticizer were added to 80 parts of polyether polyol and then transfer molding was carried out to produce an ink jet recording head according to the above-mentioned process. The structure member 3 of the head was constituted of a rubber-like material having a Young's modulus of elasticity of 400 g/mm$^2$. It was confirmed that the head satisfied the characteristic features to shearing bonding force as defined in the present invention.

When an ink was discharged by use of the head, better results were obtained as compared with a head of the prior art.

EXAMPLE 2

This example shows preventing heat shrinkage of a synthetic resin constituting the structure member 3 by adding a pigment to the synthetic resin.

As the synthetic resin constituting the structure member 3, a mixture of "Epikote 828" (trade name, made by Shell Chemistry K.K., non-solvent type epoxy resin in liquid state at ordinary temperature), "Epikote 1001" (trade name, made by Shell Chemistry K.K., epoxy resin in solid state at ordinary temperature) and "Adeka-Hardner" (trade name, made by Asahi Denka K.K., polyamide resin) was used in the mixing ratio described below. As an inorganic pigment, ultra-fine barium salfate "BF-i" (trade name, made by Sakai Denka K.K.) was added at the ratio described below and then transfer molding was carried out to produce an ink jet recording head according to the above-mentioned process.

Epikote 828: 25 parts
Epikote 1001: 5 parts
Adeka-Hardner: 10 parts
BF-1: 60 parts The structure member 3 of the produced head exhibited the following values.

Cure shrinkage: 1.25%
Linear expansion coefficient: $6.5\times10^{-5}$/°C.
Elastic modulus: 330 kg/mm$^2$
From the results, it was confirmed that the head satisfied the characteristic features to shearing bonding force of the present invention.

When an ink was discharged by use of the head, better results were obtained as compared with a head of the prior art.

EXAMPLE 3

This example shows reducing the stress to be generated in a synthetic resin constituting the structure member 3 and preventing heat shrinkage of the resin by adding both a plasticizer and a pigment to the synthetic resin.

As the synthetic resin constituting the structure member 3, polyether polyol was used.

15 parts of polyisocyanate as the plasticizer and 40 parts of carbon black (made by Degusa Company) as the pigment were added to 45 parts of the polyether polyol and then transfer molding was carried out to produce an ink jet recording head according to the above-mentioned process. The structure member 3 of the head was rubber-like material having a Young's modulus of elasticity of 1000 g/mm$^2$ and a linear expansion coefficient of $4.5\times10^{-5}$/° C. From the results, it was confirmed that the head satisfied the characteristic features to shearing bonding force of the present invention.

When an ink was discharged by use of the head, better results were obtained as compared with a head of the prior art.

EXAMPLE 4

This example shows improving shearing bonding force itself, reducing the stress to be generated in a synthetic resin consituting the structure member 3 and preventing head shrinkage of the synthetic resin by surface treating the element surface 1*a* of the base member 1 with a silane coupling agent and by adding both a plasticizer and a pigment to the synthetic resin.

An ink jet recording head was produced in the same manner as Example 1 with the exception that an additional step was further carried out in which a thin film of a treating agent in a thickness of about 1 μm was formed by surface treating the element surface 1*a* of the base member 1 by use of the following treating agent.

"S-Lec" (trade name, made by Sekisui Chemical K.K.,
butyral resin): 20 parts
Polyisocyanate: 1 part
Solvent consisting of alcohol and xylene: 78 parts
Silane coupling agent: 1 part It was confirmed that the head also satisfied the characteristic features to shearing bonding force of the present invention.

When an ink was discharged by use of the head, better results were obtained as compared with a head of the prior art.

Figure 9:
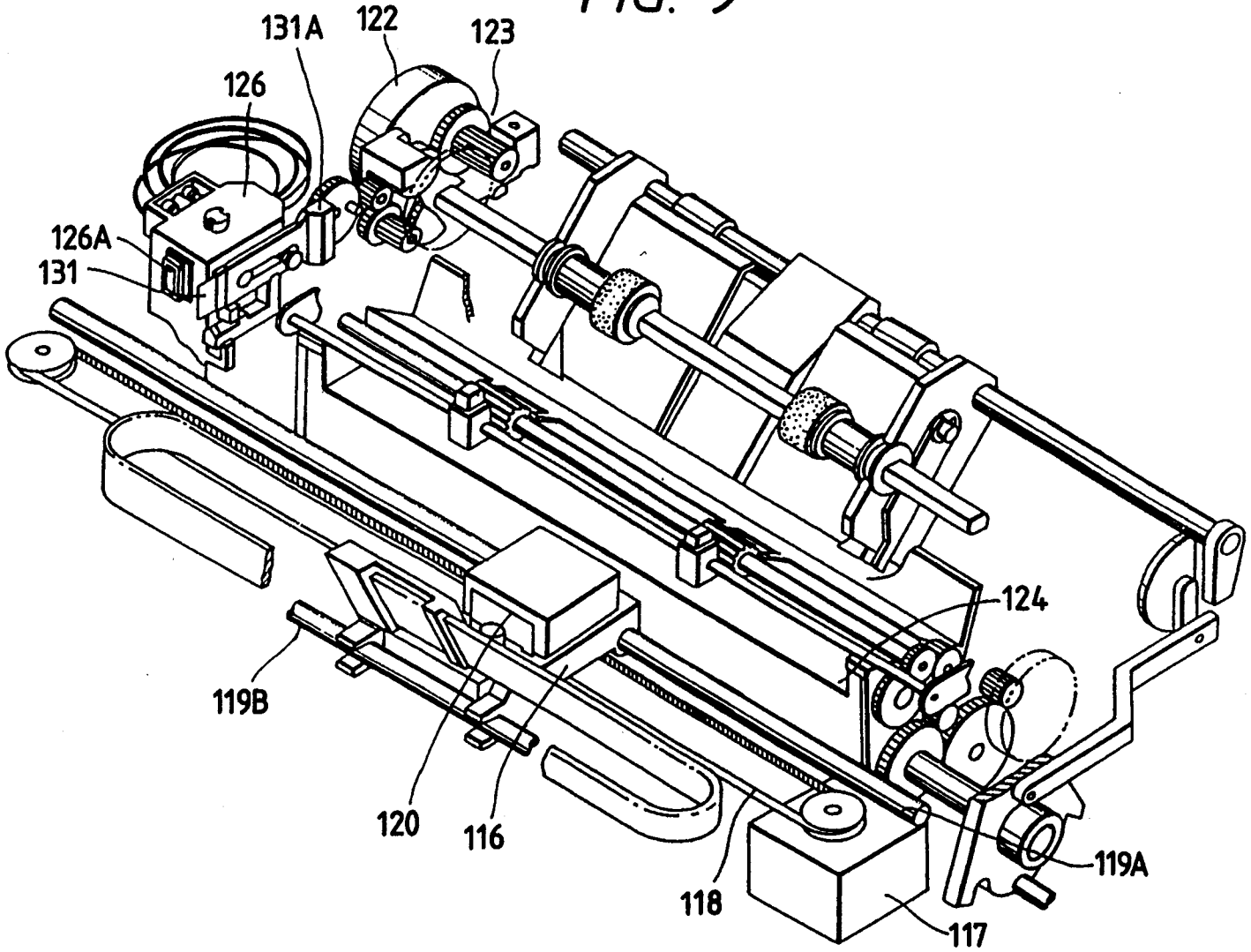
FIG. 9 is a perspective view showing the appearance of one example of an ink jet recording apparatus, provided with the present ink jet recording head as an ink jet cartridge.

FIG. 9 is a perspective view showing the appearance of one embodiment of an ink jet recording apparatus (IJRA) provided with the present ink jet recording head as an ink jet recording head cartridge (IJC), wherein an ink jet head cartirdge (IJC) 120 has a group of orifices for discharging an ink onto the recording surface of a recording sheet supplied onto a platen 124. A carriage HC 116 for supporting IJC 120 is linked to a part of a driving belt 118 that transmits the driving force from a driving motor 117 to make itself slidable along two guide shafts 119A and 119B provided in parallel to each other, whereby IJC 120 can be reciprocally moved over the full width of the recording sheet.

A head recovering apparatus 126 is provided at one end of the moving route for IJC 120, for example, at a position opposite to the home position. By a driving force from a motor 122 through a transmission mechanism 123, the head recovering apparatus 126 is actuated to conduct capping of IJC 120. Ink suction is carried out by an appropriate suction means provided in the head recovering apparatus 126 or ink pumping is carried out by an appropriate pressurizing means provided in the ink supply route to IJC 120 in connection to the capping of IJC 120 by the capping part 126A of the head recovering apparatus 126, whereby the ink is forcedly discharged from the orifice to conduct the discharge recovering treatment such as removal of thickened ink from the orifice. By capping after the completion of recording, etc., IJC 120 can be protected.

A blade 131 is provided at the side surface of the head recovering apparatus 126 and is a wiping member made from silicone rubber. The blade 131 is held on the blade-holding member 131A in a cantilever form and actuated by the motor 122 through the transmission mechanism 123 as in the case of the head recovering apparatus 126 to allow itself to engage with the face of discharge port of IJC 120. With an appropriate timing in the recording operation of IJC 120 or after the discharge recovering treatment with the head recovering apparatus 126, the blade 131 is projected into the moving route for IJC 120 to wipe dews, welting or dusts from the face of discharge port of IJC 120 in accordance with the moving operation of IJC 120.

The present invention is effective particularly for a recording head of ink discharge system based on utilization of thermal energy among the ink jet recording systems and for an apparatus for ink jet recording comprising the above-mentioned recording head.

Its typical structure and principle are preferable those disclosed, for example, in U.S. Pat. Nos. 4,723,129 and 4,740,796. This system is applicable to any one of the so-called on-demand type and continuous type, but is particularly effective for the on-demand type, because when at least one driving signal capable of giving a rapid temperature increase over the nuclear boiling point in accordance to recording information is applied to electro-thermal converting elements provided in accordance to the sheet or liquid paths holding a liquid (ink), heat energy is generated in the electro-thermal converting elements to cause film boiling on the heat actuating portion of the recording head, thereby forming bubbles in the liquid (ink) in one-to-one response to the driving signal. By growth and shrinkage of the bubbles the liquid (ink) can be discharged through the discharge opening to form at least one liquid duplet. When the driving signal in a pulse form is used, the growth and shrinkage of a bubble can be carried out instantaneously and appropriately and discharge of a liquid (ink) can be carried out more preferably with a particularly good response. Suitable driving signals of such a pulse form are disclosed in U.S. Pat. Nos. 4,463,359 and 4,345,262. Much better recording can be carried out by using conditions for the temperature increase rate on the heat actuating portion disclosed in U.S. Pat. No. 4,313,124.

Besides the structure based on a combination of orifices, liquid paths and electro-thermal converting elements disclosed in the above-mentioned US patents (linear liquid paths or perpendicular liquid paths), the structures of recording heads where the heat actuating portion is provided in a bent area, disclosed in U.S. Pat. Nos. 4,558,333 and 4,459,600 are to be covered by the present invention. Furthermore, the present invention is effective also for such a structure that the common slit serves as discharge portion for a plurality of electro-thermal converting elements as disclosed in Japanese Patent Application Kokai (Laid-Open) No. 59-123670 or such a structure that an opening for absorbing the pressure wave of heat energy is made to correspond to the discharge portion, disclosed in Japanese Patent Application Kokai (Laid-Open) No. 59-138461. The recording head of a full-live type having a length corresponding to the width of the largest recording member that the recording apparatus can conduct recording may have either a structure based on a combination of a plurality of recording heads to meet the required length or a structure of one integrated recording head disclosed in the above-mentioned specifications, where the present invention can attain the above-mentioned effects more efficiently.

Furthermore, the present invention is also effective for a detachable recording head of chip type that enables electrical connection to the apparatus proper when mounted on the apparatus proper or for a recording head of a cartridge type integrally provided on the recording head itself.

It is preferable to additionally provide a recovering means for the recording head, an auxiliary means, etc. as members for the present recording apparatus, because the effects of the present invention can be much more stabilized. More specifically it is effective for stable recording to provide a capping means, a cleaning means or a pressurizing or suction means, a pre-heating means based on electro-thermal converting elements or other heating elements or a combination thereof, or conduct a pre-discharge mode for carrying out another discharge than the recording for the recording head.

Still furthermore, the present invention is very effective not only for recording mode based only on the main color such as black, etc. as a recording mode for the recording apparatus, but also for a recording apparatus based on at least one of combined colors of a plurality of different ones or a full color based on color mixing, which apparatus may either be an integrated structure of recording heads or a combination of a plurality of recording heads.

In the foregoing embodiments of the present invention, explanation has been made, referring to an ink as a liquid. Even if the ink is solidified at or below room temperature and softened or liquefied at room temperature, it is a usual practice to make temperature adjustment the ink itself within a range of 30° to 70° C. in the case of the ink jet application, thereby controlling the temperature so that the ink viscosity can fall within the stable discharge range. That is, any ink can be used, so far as it is in a liquid state when a recording signal is input. Furthermore, such an ink that can be liquefied by heat energy as those which can be liquefied in accordance of a recording signal in the form of heat energy and discharged as a liquid or solidified when it reaches the recording member can be used in the present invention, where the temperature elevation by the heat energy is intensively utilized as energy for changing the solid state of the ink to a liquid state or the ink is solidified for preventing the evaporation of the ink when left standing. In that case, the ink can be kept in a liquid or solid state in the recess of a porous sheet or perforations and in the form against the electro-thermal converting elements, as disclosed in Japanese Patent Applications Kokai (Laid-Open) Nos. 54-56847 and 60-71260. In the present invention, the most effective system for the above-mentioned inks is a film boiling system.

In the present ink jet recording head, peeling or separation of synthetic resin from the base member due to a difference in the temperature between the production and the application of the ink jet recording head can be effectively prevented by satisfying at least one of the two conditions that (1) the shearing bonding force between the resin member having orifices and ink paths and the base member must be larger than a stress generated due to a difference in the coefficient of thermal expansion between the resin member and the base member and (2) the shearing bonding force must be larger than a stress generated within the resin member at the molding, and a highly reliable ink jet recording head having a large liquid chamber can be effectively produced in the present invention.

In the present process for producing an ink jet recording head, positioning of ink paths can be made on a base member with high exactness and less stop number by forming a solid layer made from a removable material at parts destined for ink paths on the base member, providing a resin member thereon by transfer molding so as to cover the solid layer, and then removing the solid layer, thereby forming the ink paths, and highly reliable ink jet recording heads can be produced on a mass production scale at a low production cost in the present invention.

What is claimed is:

1. A process for producing an ink jet head, comprising the steps of:

providing a base member having an energy-generating means for generating energy used for discharging an ink;

providing a solid layer made from a removable material in a pattern corresponding to an ink path on the surface of the base member provided with the energy-generating means;

arranging a mold at a side of the solid layer of the base member to form a space between the base member and the mold;

charging a resin containing a plasticizer into the space to effect transfer molding, thereby bonding the resin to the base member and the solid layer;

removing the mold; and removing the solid layer to form the ink path.

2. A process according to claim 1, further comprising the step of applying a surface treatment with a silane coupling agent onto the base member.

3. A process for producing an ink jet head, comprising the steps of:

providing a base member having an energy-generating means for generating energy used for discharging an ink;

providing a solid layer made from a removable material in a pattern corresponding to an ink path on the surface of the base member provided with the energy-generating means;

arranging a mold at a side of the solid layer of the base member to form a space between the base member and the mold;

charging a resin containing a pigment into the space to effect transfer molding, thereby bonding the resin to the base member and the solid layer;

removing the mold; and removing the solid layer to form the ink path.

4. A process according to claim 3, further comprising the step of applying a surface treatment with a silane coupling agent onto the base member.

5. A process according to claim 3, wherein the resin further comprises a plasticizer.

6. A process according to claim 5, further comprising the step of treating the surface of the base member with a silane coupling agent.

* * * * *

UNITED STATES PATENT AND TRADEMARK OFFICE

CERTIFICATE OF CORRECTION

PATENT NO. : 5,436,650

DATED : July 25, 1995

INVENTOR : JUNICHI KOBAYASHI, ET AL.

It is certified that errors appear in the above-identified patent and that said Letters Patent is hereby corrected as shown below:

COLUMN 1

Line 41, "the" (second occurrence) should be deleted.

COLUMN 3

Line 46, "covering" should read --cover--.

CCOLUMN 4

Line 25, "less" should read --fewer--.

COLUMN 5

Line 16, "an" should be deleted; and

Line 19, "form" should read --formed--.

COLUMN 8

Line 16, "is" should read --are--.

COLUMN 9

Line 67, "layer" should read --larger--.

COLUMN 12

Line 10, "an other" should read --another--; and

Line 68, "path. Walls" should read --path walls--.

UNITED STATES PATENT AND TRADEMARK OFFICE

CERTIFICATE OF CORRECTION

PATENT NO. : 5,436,650

DATED : July 25, 1995

INVENTOR : JUNICHI KOBAYASHI, ET AL.

It is certified that errors appear in the above-identified patent and that said Letters Patent is hereby corrected as shown below:

COLUMN 13

Line 51, "salfate"BF-i"" should read --sulfate "BF-1"--.

COLUMN 15

Line 36, "preferable" should read --preferably--;

Line 52, "duplet." should read --droplet.--; and

Line 65, "US" should read --U.S.--.

COLUMN 16

Line 51, "ment" should read --ment to--.

Signed and Sealed this

Twelfth Day of December, 1995

Bruce Lehman

*Attest:*

BRUCE LEHMAN

*Attesting Officer*

*Commissioner of Patents and Trademarks*